United States Patent [19]

Dalseide

[11] Patent Number: 4,654,938

[45] Date of Patent: Apr. 7, 1987

[54] DESCALER HEAD ASSEMBLY FOR A DESCALING MACHINE

[75] Inventor: Tore Dalseide, Bekkjarvik, Norway

[73] Assignee: Dalseide & Co., Bekkjarvik, Norway

[21] Appl. No.: 590,757

[22] Filed: Mar. 19, 1984

[30] Foreign Application Priority Data

Mar. 22, 1983 [NO] Norway ..... 830996

[51] Int. Cl.[4] ..... B21C 43/00

[52] U.S. Cl. ..... 29/81 E; 241/193

[58] Field of Search ..... 29/81 R, 81 L, 81 E, 29/81 J; 15/198, 200, 243, 242, 249, 236 C; 241/193; 144/208 J

[56] References Cited

U.S. PATENT DOCUMENTS

| | | | |
|---|---|---|---|
| 1,694,018 | 12/1928 | Mudge et al. | 15/198 X |
| 2,851,028 | 9/1958 | Asbury | 15/198 X |
| 3,342,426 | 9/1967 | Sackett, Sr. | 241/193 X |
| 4,002,491 | 1/1977 | Esparza | 15/198 X |

FOREIGN PATENT DOCUMENTS

| | | | |
|---|---|---|---|
| 964965 | 3/1975 | Canada | 144/208 J |
| 140881 | 8/1979 | Norway . | |
| 613890 | 12/1948 | United Kingdom | 29/81 E |

*Primary Examiner*—Mark Rosenbaum

*Attorney, Agent, or Firm*—Kenyon & Kenyon

[57] ABSTRACT

Descaler head assembly having peripherally successive and longitudinally successive series of descaler elements (11, 12). The assembly is made up of a central support shaft (15) which is securely threaded through a series of mutually separate, rigid holding elements (10) for connecting elements (13, 14) of the descaler elements (11, 12) for rotation therewith, the connecting elements being fastened in pairs or groups to the holding elements (10). The connecting elements are each in the form of a relatively short piece of chain, piece of wire or similar flexible means and are connected to the holding elements at a considerable distance from the axis of rotation of the shaft. The position of the connecting elements relative to each other is determined by the angularly set positions of the holding elements and axially set positions on the support shaft (15). The holding elements (10) are fastened together in an axial direction by means of regulatable tightening means (17) on the support shaft (15) or on, if desired, extra fastening laths (34) between the holding elements.

3 Claims, 4 Drawing Figures

DESCALER HEAD ASSEMBLY FOR A DESCALING MACHINE

This invention relates to a descaler head assembly for a descaling machine.

In Norwegian Patent Specification No. 140,881 there is shown a descaler which comprises a carriage-like apparatus which is adapted to be moved via wheels or similar support means along a surface which is to be treated by the descaler. The descaler comprises a descaler head which is rotatably mounted with a regulatable speed and which is provided with peripherally successive and longitudinally successive series of descaler elements. The descaler elements are fastened to the descaler head at a considerable distance from its rotary axis via associated pieces of chain, pieces of wire or similar longitudinally flexible means. There is disclosed a descaler head in the form of a cylindrical drum which is provided with series of peripherally successive and longitudinally successive, stationarily placed fastening straps for fastening the associated pieces of chain of the descaler elements.

An aim of the present invention is a descaler head for application in a descaler of corresponding or similar kind to that which is illustrated and described in the Norwegian Patent Specification No. 140,881. A particular objective is a solution where the descaler elements are easily replaceable while a simple and effective construction for the descaler head and associated parts is provided.

Accordingly, the present invention resides in a descaler head assembly for a descaling machine and which comprises a series of mutually separate, rigid holding elements through which a central support shaft is securely threaded for rotation therewith, regulatable tightening means on the shaft for fastening together the holding elements in an axial direction, flexible connecting elements mounted in groups on the holding elements at a substantial distance from the axis of the shaft and selected from relatively short pieces of chain, wire and the like, and descaler elements connected to the holding elements via the connecting elements in peripherally and longitudinally successive series, the holding elements being set at adjustable angular positions relative to each other.

The descaler elements can be replaced in a relatively easy manner in pairs or groups, if desired together with one or more associated holding elements, for example in that the holding elements together with the descaler elements and associated connecting elements form a coherent installation component. At the same time, there can be obtained a light weight construction for the descaler head, the holding elements (the installation components) together with the support shaft in a fastened together condition bracing each other mutually to form a rigid descaler head assembly.

Figure 1:
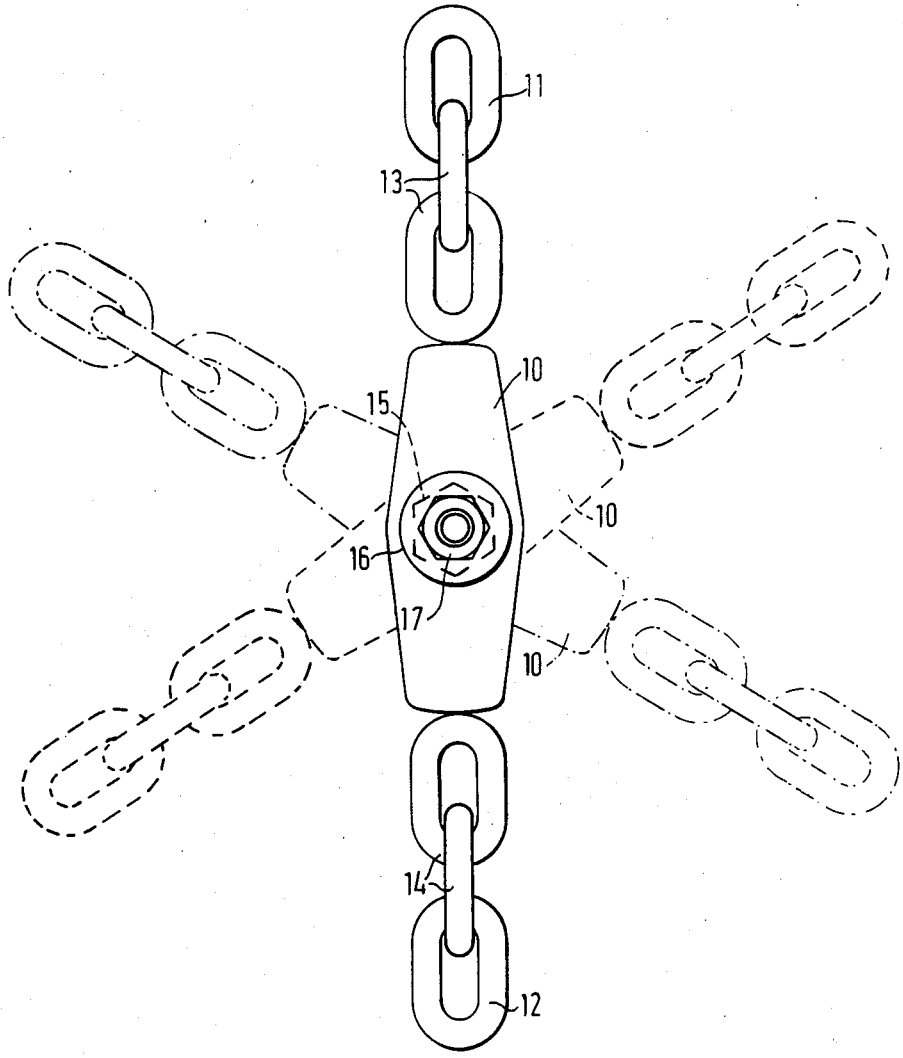
Figure 2:
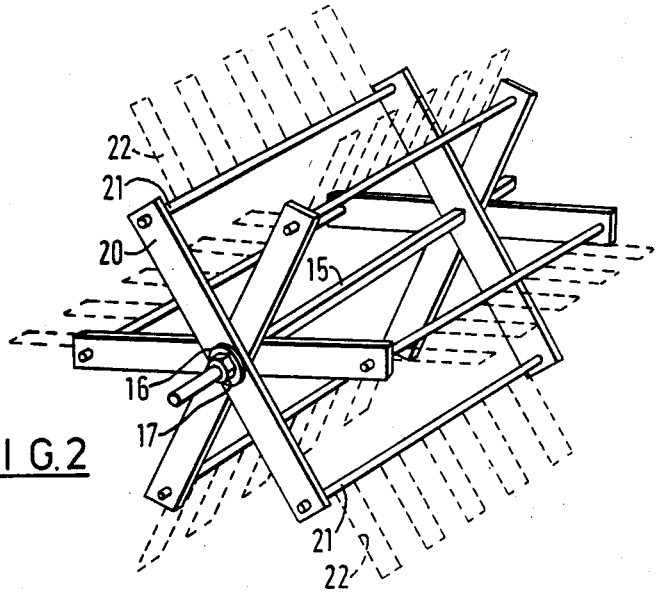
Figure 4:
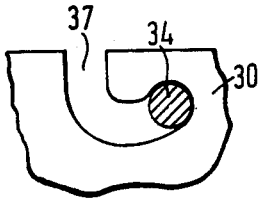
Figure 3:
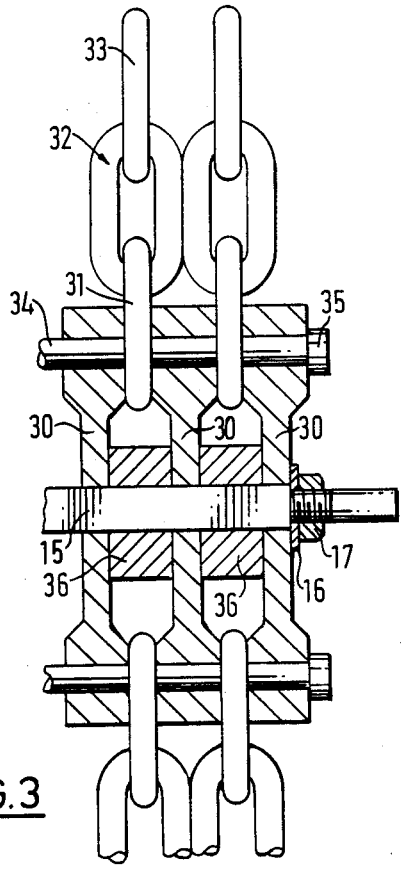

In order that the invention can be more clearly understood, convenient embodiments thereof will now be described, by way of example, with reference to the accompanying drawings in which:

FIG. 1 is an end view of a descaler head assembly showing a holding element with associated descaler elements and connecting elements in three difference positions, FIG. 2 is a perspective view of a descaler head assembly of a second embodiment, FIG. 3 is a vertical cut-off section of a descaler head assembly of a third embodiment, FIG. 4 is a cut away end view, partly in section, of a detail of a holding element of the third embodiment shown on an enlarged scale.

Referring to FIG. 1, a holding element 10 is in the form of a bar-shaped member to the opposite ends of which are secured two descaler elements 11 and 12 via associated connecting elements 13 and 14. The connecting element consists of a piece of chain while the descaler element is formed by the outermost link on the piece of chain. What is aimed at is a specially hardened chain which can tolerate large wear and tear. Alternatively, the outermost link can consist of a specially made descaler element while the two inner links can constitute conventional chain links.

Centrally in the holding element 10, there is designed a six-edged cavity for the reception of a correspondingly six-edged support shaft 15 (shown in broken lines). The holding element 10 can be adjusted into three different positions as shown in full, broken and chain lines respectively. By arranging the six-edged shape of the cavity unsymmetrically relative to the longitudinal axis of the holding element, there can be obtained three more different positions by turning the holding element about its longitudinal axis. It is clear that the number of different positions for the holding element can be determined by defining the different types of multi-edges (three-edged shape, four-edged shape etc.) and having a symmetrical or unsymmetrical arrangement of the multi-edged shape relative to the longitudinal axis of the holding element. In this way, there can be constructed in a ready manner, by means of one and the same construction for the holding element, a descaler head based on securing separate installation components 10–14 in series one after the other on the common support shaft 15. At the ends, the support shaft 15 can be provided with a stop washer 16 with associated nuts 17 which are fastened on the threaded portion of the shaft 15. Axially outside the threaded portion, the shaft can be rotatably mounted in a descaler machine or in permanent rotary engagement with a driving wheel of the descaler machine. The installation components 10–14 can be pushed tightly together on the shaft 15 and located in place in this position by means of the stop washers 16 and nuts 17.

Provision is made for the descaler elements in each installation component to treat a narrow stripe in the base to be treated and the closeness of the stripes in the treated base can be established by the chosen thickness of the holding element 10.

Instead of bar-shaped holding elements, there can be employed, for example, elements having a star-shape, cross-shape or other suitable shapes so that the descaler elements and associated connecting elements can be collected in larger groups on one and the same installation component. For example, there can be employed a six-armed star shape equivalent to the three alternative positions for the holding element 10 shown in FIG. 1. In such a case, the arms can be axially offset relative to each other similar to a group of three pushed-together holding elements 10 so that there is covered, in an equivalent manner, an area of treatment with three mutually adjacent stripe formations produced by pairs of axially displaced descaler elements.

In the embodiment of FIG. 2, there is shown a pair of bar-shaped holding means, that is to say a holding element 20 at each end of the descaler head assembly, and each such pair of holding elements 20 can together with a pair of support laths 21 with, besides, permanently secured descaler elements and associated connecting elements (indicated schematically by broken lines 22) form a rectangular annular installation component 20–22. The descaler head assembly is made up of a common support shaft 15, which is essentially equivalent to that described in connection with FIG. 1, together with three such rectangular, annular installation components 20–22. The installation component 20–22 is composed of four separate parts, that is to say two holding elements 20 and two support laths 21 with associated descaler elements and connecting elements 22. The support laths 21 with associated descaler elements and connecting elements can constitute the replaceable parts of the descaler head assembly and these replaceable parts can be locked into position in engagement with the holding elements 20 by fixing the holding elements 20 on the support shaft 15 via stop washers 16 and nuts 17 in a manner corresponding to that described in connection with FIG. 1.

In the embodiment of FIG. 3, there is shown a support shaft 15 with a series of mutually parallel holding elements 30 which between them receive their respective inner chain link 31 of a piece of chain 32, the outer chain link of which forms descaler element 33. The inner chain link 31 can be stationarily secured to a support lath 34 in set positions on the latter corresponding to a set division between the holding elements 30 on the shaft 15. The support lath 34 is provided at opposite ends with a stop member 35. The distance between the holding elements can, for example, as shown in FIG. 3 be established by means of space rings 36 on the shaft 15. The holding elements 30 and the space rings 36 are separately moveable on the shaft 15, these being able to be clamped together axially and locked securely on the shaft 15 by means of the stop washers 16 and the nuts 17 at opposite ends of the shaft 15. Alternatively, the holding elements 30 and the space rings 36 can be permanently secured to the shaft 15 and constitute a coherent unit with the latter.

In FIG. 4, there is shown a solution where the support lath 34 with associated descaler elements and connecting elements (not shown) can be pushed into a hook-shaped groove 37 in associated holding element 30. In practice, the support lath 34 can be held in place in holding elements 30 of the descaler head assembly by being received with a narrow, friction-promoting fit in the grooves 37. Alternatively, one of the holding elements 30 which forms an end piece of the descaler head assembly can be turned 180° so that the groove 37 points the opposite way and thereby locks in place combined support laths 34 in associated series of holding elements 30.

Alternatively, the pieces of chain 32 can be releasable secured to the support lath 34, the support lath 34 at at least the one end being able to be provided with nuts instead of a permanent stop member 35. In such a case, one can employ single bores in the holding elements 30 instead of the grooves illustrated in FIG. 4, the support lath 34 being able to be drawn axially outwards from and pushed axially inwards into the series of aligned bores in the series of holding elements 30. The inner chain link of the piece of chain can, for example, be received with a narrow fit in the gap between two holding elements 30 so that the inner chain link of the piece of chain can be adjusted into alignment with the bores in the holding elements before the support lath 34 is pushed into the bores.

I claim:

1. For use in a descaling machine, a descaler head assembly comprising a rotatable central support shaft;

a plurality of rigid bar-shaped holding elements slidably mounted on said shaft for rotation therewith, each said holding element being angularly offset and axially displaced from an adjacent holding element along said shaft and being angularly adjustable on said shaft;

means on said shaft for fastening said holding elements together coaxially on said shaft;

a flexible connecting element mounted on each end of each holding element to extend radially of said shaft; and a descaler element connected to an end of each connecting element.

2. A descaler head as set forth in claim 1 wherein said shaft has a polygonal cross-section and each holding element has a polygonal cavity receiving said shaft in mating relation.

3. For use in a descaling machine, a descaler head assembly comprising a rotatable central support shaft;

a plurality of rigid holding elements slidably mounted on said shaft for rotation therewith, each said holding element defining at least a pair of arms and being angularly offset and axially displaced from an adjacent holding element along said shaft and being angularly adjustable on said shaft;

means on said shaft for fastening said holding elements together coaxially on said shaft;

a connecting element mounted on each end of each arm to extend radially of said shaft during rotation of said shaft; and a descaler element connected to an end of each connecting element to treat a narrow stripe in a base to be treated whereby mutually adjacent stripe formations are produced in the base during rotation of said shaft.

* * * * *